US012320223B2

(12) United States Patent
Firth et al.

(10) Patent No.: US 12,320,223 B2
(45) Date of Patent: Jun. 3, 2025

(54) SPLIT HANGER TUBING HANGER

(71) Applicant: INNOVEX DOWNHOLE SOLUTIONS, INC., Humble, TX (US)

(72) Inventors: Gary Firth, Houston, TX (US); Margaret Hamilton, Houston, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 18/541,005

(22) Filed: Dec. 15, 2023

(65) Prior Publication Data

US 2024/0209713 A1 Jun. 27, 2024

Related U.S. Application Data

(60) Provisional application No. 63/476,446, filed on Dec. 21, 2022.

(51) Int. Cl.

| | |
|---|---|
| ***E21B 33/04*** | (2006.01) |
| ***E21B 33/047*** | (2006.01) |
| *E21B 23/00* | (2006.01) |
| *E21B 23/01* | (2006.01) |
| *E21B 33/12* | (2006.01) |

(52) U.S. Cl.

CPC ..... *E21B 33/0415* (2013.01); *E21B 33/0407* (2013.01); *E21B 33/0422* (2013.01); *E21B 33/047* (2013.01); *E21B 23/006* (2013.01); *E21B 23/01* (2013.01); *E21B 33/12* (2013.01)

(58) Field of Classification Search

CPC ..... E21B 33/0415; E21B 33/0407; E21B 33/0422; E21B 33/047; E21B 23/006; E21B 23/01; E21B 33/12

See application file for complete search history.

(56) References Cited

U.S. PATENT DOCUMENTS 4,600,054 A 7/1986 Miller et al.
5,813,468 A 9/1998 Borak, Jr.
(Continued)

FOREIGN PATENT DOCUMENTS

CN 208137899 U 11/2018
CN 112012686 A 12/2020

OTHER PUBLICATIONS

International Search Report and Written Opinion dated Apr. 24, 2024, PCT Application No. PCT/US2023/084163, 10 pages.

*Primary Examiner* — Nicole Coy
*Assistant Examiner* — Jennifer A Railey
(74) *Attorney, Agent, or Firm* — MH2 Technology Law Group, LLP

(57) ABSTRACT

An assembly configured to be inserted into a wellhead includes a body and a door that is pivotally coupled to the body. The door is configured to pivot between a closed position and an open position. An interface between the body and the door defines a first passage configured to have a cable pass therethrough, and a second passage configured to have a secondary tube pass therethrough. The assembly also includes one or more hinges that pivotally couple the body to the door. The one or more hinges include a first hinge that is recessed at least partially into the body and the door. The assembly also includes a primary seal insert positioned at least partially within the body and the door. The primary seal insert expands radially-outward to seal with the wellhead in response to being axially-compressed.

19 Claims, 13 Drawing Sheets

(56) References Cited

U.S. PATENT DOCUMENTS

| | | | | |
|---|---|---|---|---|
| 6,530,433 | B2 | 3/2003 | Smith et al. | |
| 7,798,208 | B2 | 9/2010 | Purkis | |
| 8,485,262 | B1 | 7/2013 | Angers | |
| 8,573,294 | B2 | 11/2013 | Struthers et al. | |
| 9,303,469 | B1 * | 4/2016 | Keast | E21B 19/06 |
| 10,837,252 | B2 | 11/2020 | Angers, Jr. | |
| 10,947,808 | B2 | 3/2021 | Angers, Jr. | |
| 2007/0158077 | A1 | 7/2007 | McGuire et al. | |
| 2021/0238945 | A1 * | 8/2021 | Angers, Jr. | E21B 33/12 |
| 2021/0388692 | A1 | 12/2021 | Ferguson et al. | |

* cited by examiner

SPLIT HANGER TUBING HANGER

CROSS-REFERENCE TO RELATED APPLICATIONS

This patent application claims priority to U.S. Provisional Patent Application No. 63/476,446, filed on Dec. 21, 2022, which is incorporated by reference.

BACKGROUND

Wellhead assemblies are positioned at a top of a well and generally include one or more devices that control fluid flow into and out of the well. For example, wellhead assemblies may include a blowout preventer, positioned on a wellhead, with an adapter therebetween. A tubing hanger may be disposed in the wellhead and landed on a shoulder or another load surface therein. Production tubing, through which fluid recovered from the well flows, may be coupled to the tubing hanger and suspended therefrom into the well.

Safety regulations may require that the wellhead assemblies be capable of withstanding a high amount of transient upward pressure differentials (e.g., high pressure within the well) below the wellhead in comparison to the pressure above the wellhead. In particular, the tubing hanger may be secured against upward displacement relative to the wellhead using a lockdown device.

Further, cables are often run into the well along with the tubing. For example, power cables for electronic submersible pumps (ESP) may be secured to the tubular as it is run into the well. Various other cables/tubing may also be run. Tubular running operations, however, are often not a single, continuous activity, but may start and stop for a variety of reasons. Generally, the production tubing is run in segments, which are connected together as a string. To temporarily terminate tubular running operations, generally at the conclusion of running one of the tubular segments, the production tubing is secured in slips in the wellhead, the cable(s) and/or other tubing that are run along with the production tubing are severed, and the blowout preventer is closed, sealing the well. Alternatively, well kill fluid may be circulated continuously into the well to control pressure at the wellhead.

What is needed is a system and method for running cables and other tubing along with a production tubing that permits temporary sealing of the well, without severing the cable or tubing, and reducing or avoiding continuously circulating fluid in the well.

SUMMARY

An assembly configured to be inserted into a wellhead is disclosed. The assembly includes a body and a door that is pivotally coupled to the body. The door is configured to pivot between a closed position and an open position. An interface between the body and the door defines a first passage configured to have a cable pass therethrough, and a second passage configured to have a secondary tube pass therethrough. The assembly also includes one or more hinges that pivotally couple the body to the door. The one or more hinges include a first hinge that is recessed at least partially into the body and the door. The assembly also includes a primary seal insert positioned at least partially within the body and the door. The primary seal insert expands radially-outward to seal with the wellhead in response to being axially-compressed.

A split hanger assembly configured to be inserted into a wellhead is also disclosed. The split hanger assembly includes a body configured to be positioned between an upper sub and a lower sub. The split hanger assembly also includes a door that is pivotally coupled to the body. The door is configured to pivot between a closed position and an open position. An interface between the body and the door defines a first passage configured to have a cable pass therethrough from the upper sub to the lower sub, and a second passage configured to have a secondary tube pass therethrough from the upper sub to the lower sub. The split hanger assembly also includes one or more hinges that pivotally couple the body to the door. The one or more hinges include a first hinge that is recessed at least partially into the body and the door. The split hanger assembly also includes one or more flanges coupled to the upper surface of the body, the door, or both. The one or more flanges are configured to compress packing seals into fluid-tight engagement with the cable, the body, and the door and with the secondary tube, the body, and the door. The split hanger assembly also includes a primary seal insert positioned at least partially within the body and the door. The primary seal insert expands radially-outward to seal with the wellhead in response to being axially-compressed. The split hanger assembly also includes an axial load-bearing feature positioned between the body and the door that transfers axial loads from the split hanger assembly to the wellhead.

A split hanger assembly configured to be inserted into a wellhead and to support a production tubing within a wellbore is also disclosed. The split hanger assembly includes a body configured to be positioned between an upper sub and a lower sub. The split hanger assembly also includes a door that is pivotally coupled to the body. The door is configured to pivot between a closed position and an open position. One or more first captive fasteners secure the door in the closed position. An interface between the body and the door defines a first passage configured to have a cable pass therethrough from the upper sub to the lower sub, and a second passage configured to have a secondary tube pass therethrough from the upper sub to the lower sub. The split hanger assembly also includes one or more hinges that pivotally couple the body to the door. The one or more hinges include a first hinge that is recessed at least partially into the body and the door. The split hanger assembly also includes one or more flanges coupled to an upper surface of the body, the door, or both. The one or more flanges are configured to compress packing seals into fluid-tight engagement with the cable, the body, and the door and with the secondary tube, the body, and the door. One or more second captive fasteners secure the one or more flanges to the body, the door, or both. The split hanger assembly also includes a primary seal insert positioned at least partially within the body and the door and above the first hinge. The primary seal insert expands radially-outward to seal with the wellhead in response to being axially-compressed. The split hanger assembly also includes an axial load-bearing feature between the body and the door that transfers axial loads from the split hanger assembly to the wellhead. The axial load-bearing feature includes a lug that is coupled to or integral with the body and a recess formed in the door.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
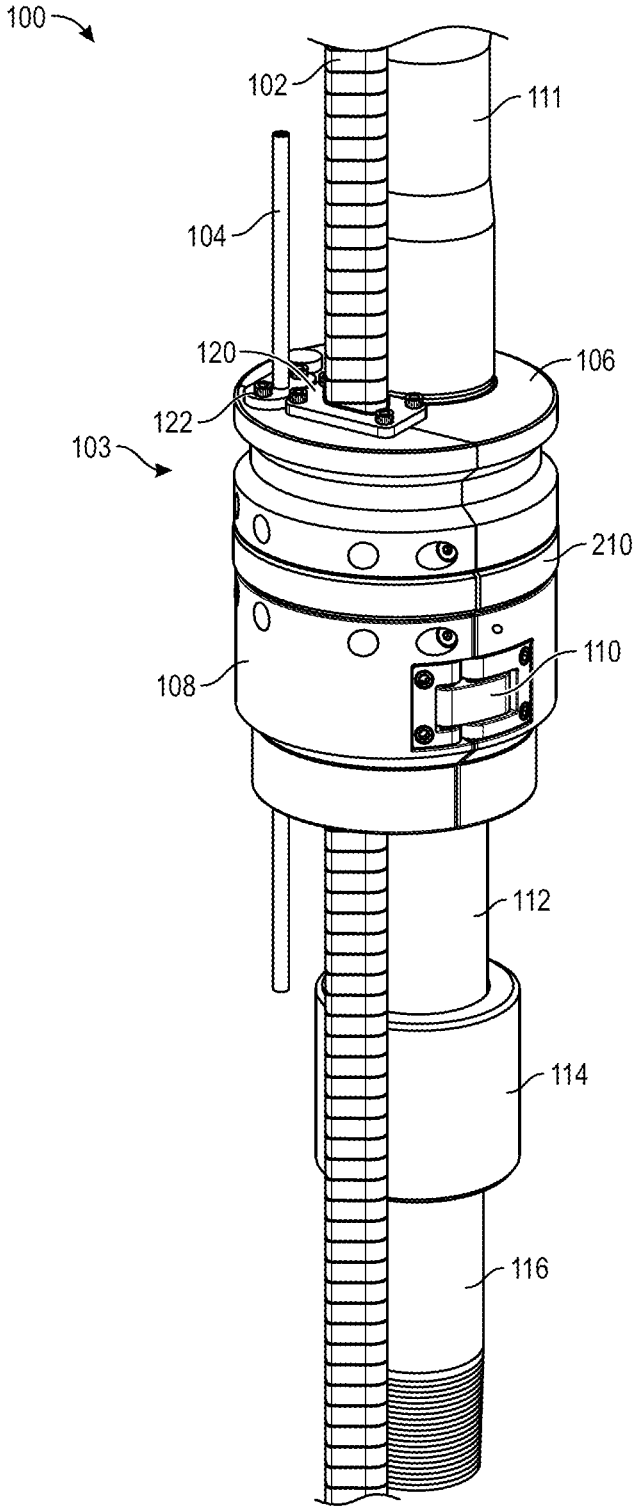
FIG. 1 illustrates a side, perspective view of a split hanger assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a split hanger assembly 100, according to an embodiment. The split hanger assembly 100 may be configured to be inserted into a wellhead, generally in a standard tubing hanger position. The split hanger assembly 100 may support a string of pipes, which make up the production tubing, such that the production tubing may be suspended therefrom and extend into the well. The split hanger assembly 100 may also be configured to seal with and permit passage of a cable 102 therethrough, as well as, in at least some embodiments, a secondary tube 104, which may be another cable (e.g., optical, electrical, pneumatic, hydraulic, etc.) or may permit for a fluid passage.

The split hanger assembly 100 includes a split hanger 103, which is made up at least partially of a main body 106 and a side door 108 that is pivotally coupled to the main body 106 via a hinge 110. In the illustrated closed position, the side door 108 and the main body 106 generally form a cylindrical member. A first (e.g., upper) sub 111 may be coupled to the top of the main body 106, and a second (e.g., intermediate) sub 112 may be coupled to the bottom of the main body 106. In at least some embodiments, the main body 106 may permit fluid communication between the upper sub 111 and the intermediate sub 112 through a bore formed within the main body 106.

A swivel 114 may be coupled to a lower end of the intermediate sub 112, and a lower sub 116 may extend from the bottom of the swivel 114. The production tubing (not shown) may be connected to the lower sub 116, or the lower sub 116 may be omitted, and the swivel 114 may be connected directly to the production tubing.

The split hanger 103 may be configured to permit passage of the cable 102 and the secondary tube 104 therethrough. For example, the interface between the side door 108 and the main body 106 may provide passages axially through the split hanger 103 for the cable 102 and the secondary tube 104. Flanges 120, 122 may be secured to an upper axial face of the main body 106 and the side door 108 to compress packing seals (not visible in this Figure) into fluid-tight engagement with the respective cable 102 or tube 104 and the main body 106 and side door 108.

The split hanger 103 may also include a primary seal insert 210. The primary seal insert 210 may serve a function similar to an O-ring with respect to the exterior of the split hanger 103. That is, in axial compression, such as when the split hanger 103 is set down on a wellhead load shoulder, the primary seal insert 210 may expand radially outwards from the main body 106 and the door 108 and form a seal with the wellhead.

Figure 2:
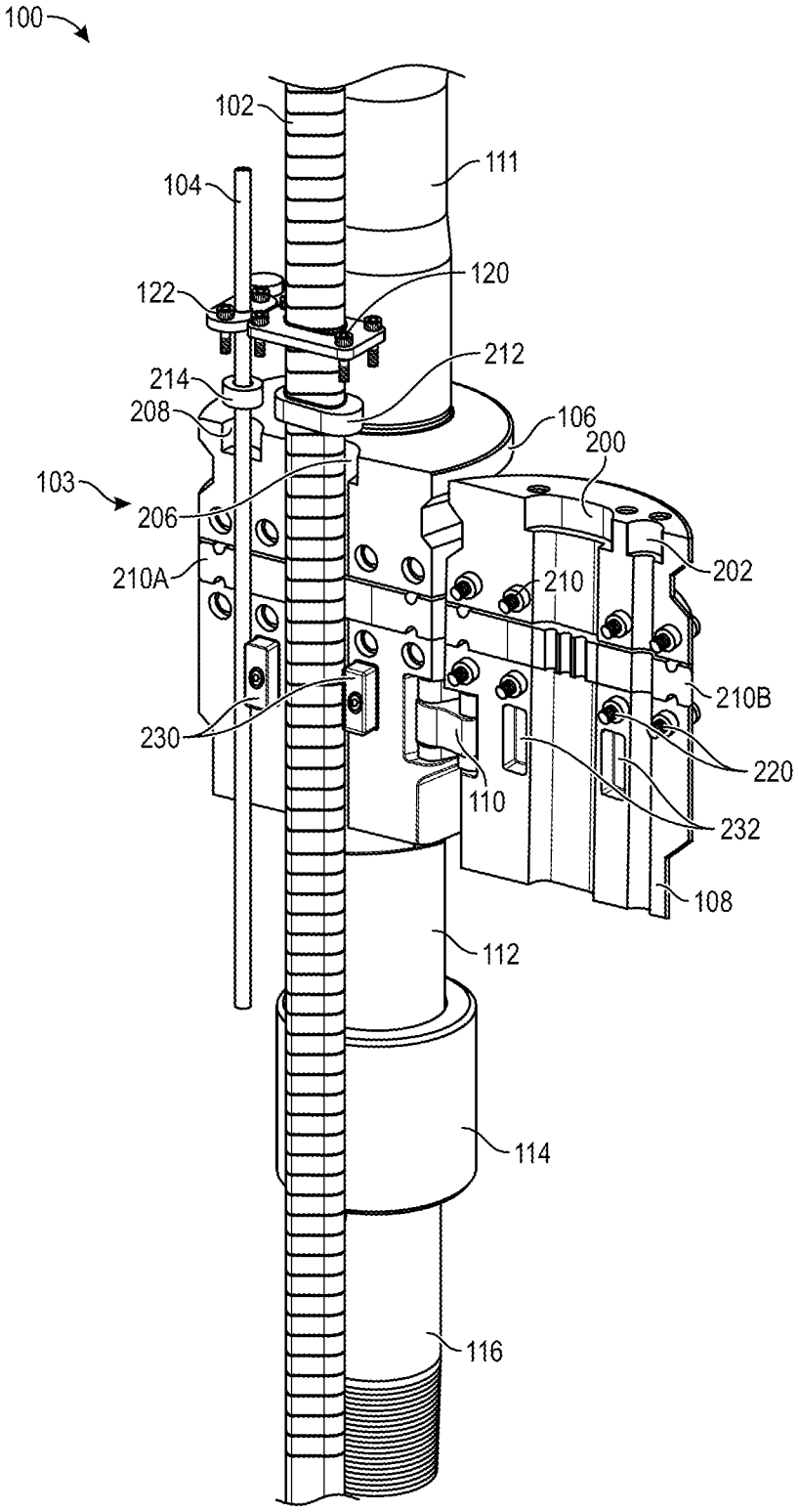
FIG. 2 illustrates a side, perspective view of the split hanger assembly, showing a door thereof in an open position, according to an embodiment.

FIG. 2 illustrates a perspective view of the split hanger assembly 100 with the door 108 of the split hanger 103 in an open position, according to an embodiment. As noted above, the split hanger 103 provides a passage for the cable 102 and a passage for the secondary tube 104 axially therethrough. More particularly, the door 108 may define a first groove 200 and a second groove 202, and the main body 106 may define a first groove 206 and a second groove 208. The first grooves 200, 206 may align when the door 108 is closed, so as to provide a through-going passageway for the cable 102. Similarly, the second grooves 202, 208 may align when the door 108 is closed, so as to provide a through-going passageway for the secondary tube 104.

As noted above, the primary seal insert 210 may be positioned in the split hanger 103, e.g., near the axial middle thereof. In at least some embodiments, the primary seal insert 210 may be provided by two inserts 210A, 210B, with the first insert 210A surrounding the main body 106 and the second insert 210B surrounding the side door 108. When the door 108 is closed, the first and second seal inserts 210A, 210B are pressed together and pressed against the cable 102 and the secondary tube 104, thereby preventing communication between the door 108 and the main body 106 along the cable 102 and/or the secondary tube 104. The primary seal insert 210 is shown in greater detail in FIGS. 9A and 9B, described below.

As mentioned above, the split hanger 103 may also include packing seals 212, 214, which may be received around the cable 102 and the secondary tube 104, respectively, and compressed by the flanges 120, 122. Accordingly, each of the cable 102 and the secondary tube 104 may be sealed by two separate sealing members: the primary seal insert 210 and the packing seals 212, 214.

A series of fasteners, such as bolts 220 may be configured to secure the door 108 in the closed position, while being releasable to permit the door 108 to open. In particular, as shown, the bolts 220 may be positioned above and below the primary seal insert 210, so as to ensure a fluid-tight compression of the primary seal insert 210 within the split hanger 103.

An axial load-bearing feature may also be provided between the door 108 and the main body 106, which in turn transfers the axial loads to the wellhead. The axial load-bearing feature may include, for example, lugs 230 that are received into recesses 232, as shown. In other embodiments, various other structures such as shoulders, steps, keyways, etc. may be used instead of or in addition to lugs. The axial load-bearing feature may prevent or at least mitigate shearing forces applied to the bolts 220, which might otherwise damage the bolts 220 and reduce the ability to easily release these bolts 220 so that the door 108 can be opened.

Figure 3:
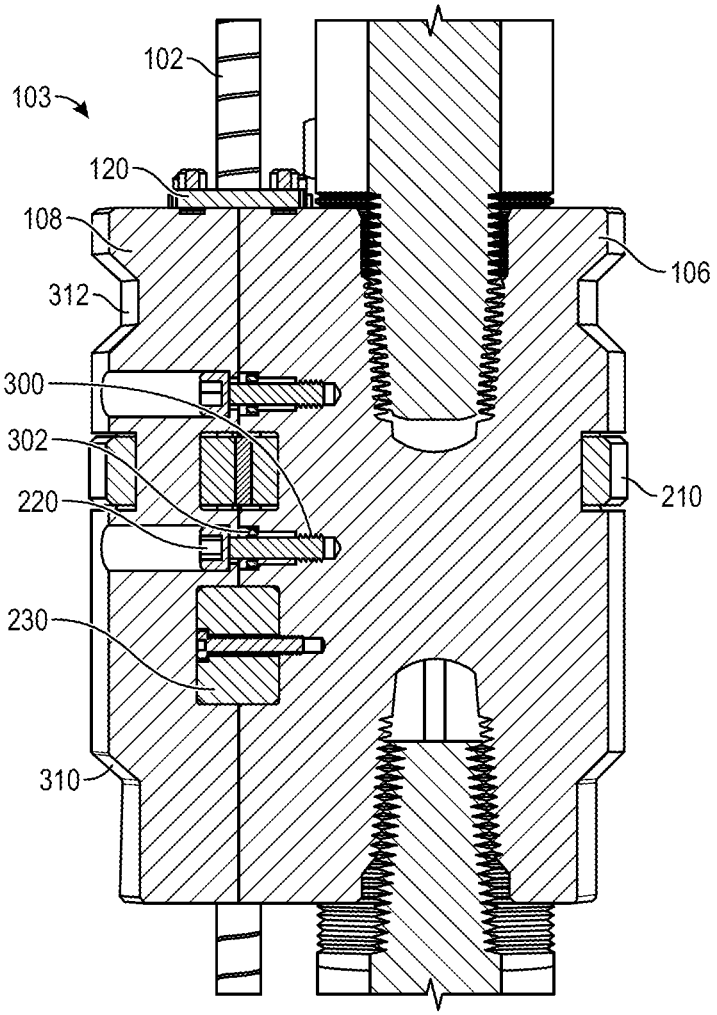
FIG. 3 illustrates a side-cross sectional view of a split hanger of the split hanger assembly, according to an embodiment.

FIG. 3 illustrates a side, cross-sectional view of the split hanger 103, according to an embodiment. As shown, the door 108 may, in the closed position, be flush with the body 106, such that the circumferentially-facing surfaces of each engaged. This may permit the bolts 220 to be threaded into holes 300 formed in the main body 106. The bolts 220 may be "captive," and thus prevented from falling out of the door 108 even when unthreaded from the holes 300. For example, a washer 302 may be connected to each bolt 220, which prevents the bolt 220 from sliding through the door 108. As can also be seen in this view, the primary seal insert 210 surrounds each of the main body 106 and the door 108, but is not solid; rather, the main body 106 and the door 108 are solid.

Additionally, the main body 106 and the door 108 together define a load surface 310 for the split hanger 103. The load surface 310 may be configured to transfer axial loads to the wellhead, when installed therein. Further, the main body 106 and the door 108 together may define a locking groove 312, which may receive a locking member (e.g., one or more screws) when the split hanger 103 is installed in the wellhead. As also shown in FIG. 3, the lug 230 may be secured to the main body 106 via a fastener; however, in other embodiments, the lug 230 may be formed integrally with the main body 106. Further, in some embodiments, the lug 230 may be coupled to or integral with the side door 108 and received into a recess formed in the main body 106.

Figure 4:
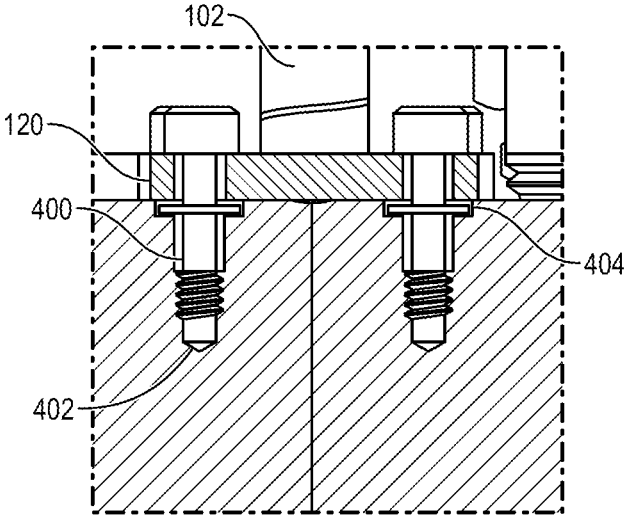
FIG. 4 illustrates an enlarged, partial, sectional view of the split hanger, showing a packing flange connected to a main body of the split hanger, according to an embodiment.

FIG. 4 illustrates the flange 120 with captive screws 400 received therethrough and into tapped holes 402 formed in the main body 106. As shown, the captive screws 400 include a washer 404 that prevents the captive screws 400 from falling out of the flange 120 when removed from connection with the holes 402.

Figure 5:
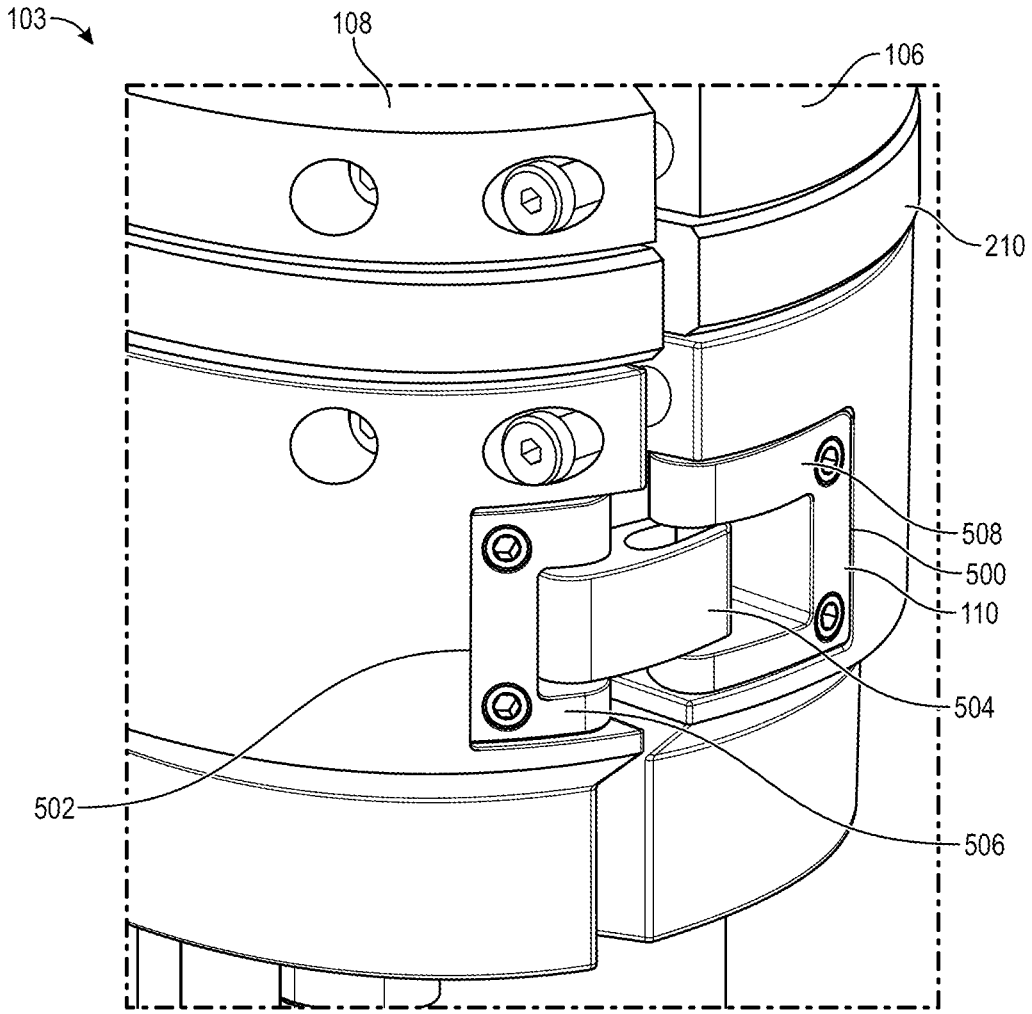
FIG. 5 illustrates an enlarged, perspective view of a portion of the split hanger, showing a hinge thereof, according to an embodiment.

FIG. 5 illustrates a perspective view of part of the split hanger 103, particularly the region where the hinge 110 is positioned. As shown, the hinge 110 may be received into cutouts 500, 502 formed in the main body 106 and the door 108. The hinge 110 may thus be recessed into the main body 106 and the door 108, such that it does not protrude radially-outward therefrom in the closed position, as shown. Further, the hinge 110 may include a center link 504 connected to two end links 506, 508, with the center link 504 being slotted to permit the hinge 110 to adjust its length. Accordingly, the door 108 and the main body 106 may move together (e.g., compressed together such that the two end links 506, 508 are closer together), rather than simply pivoting.

Figure 6:
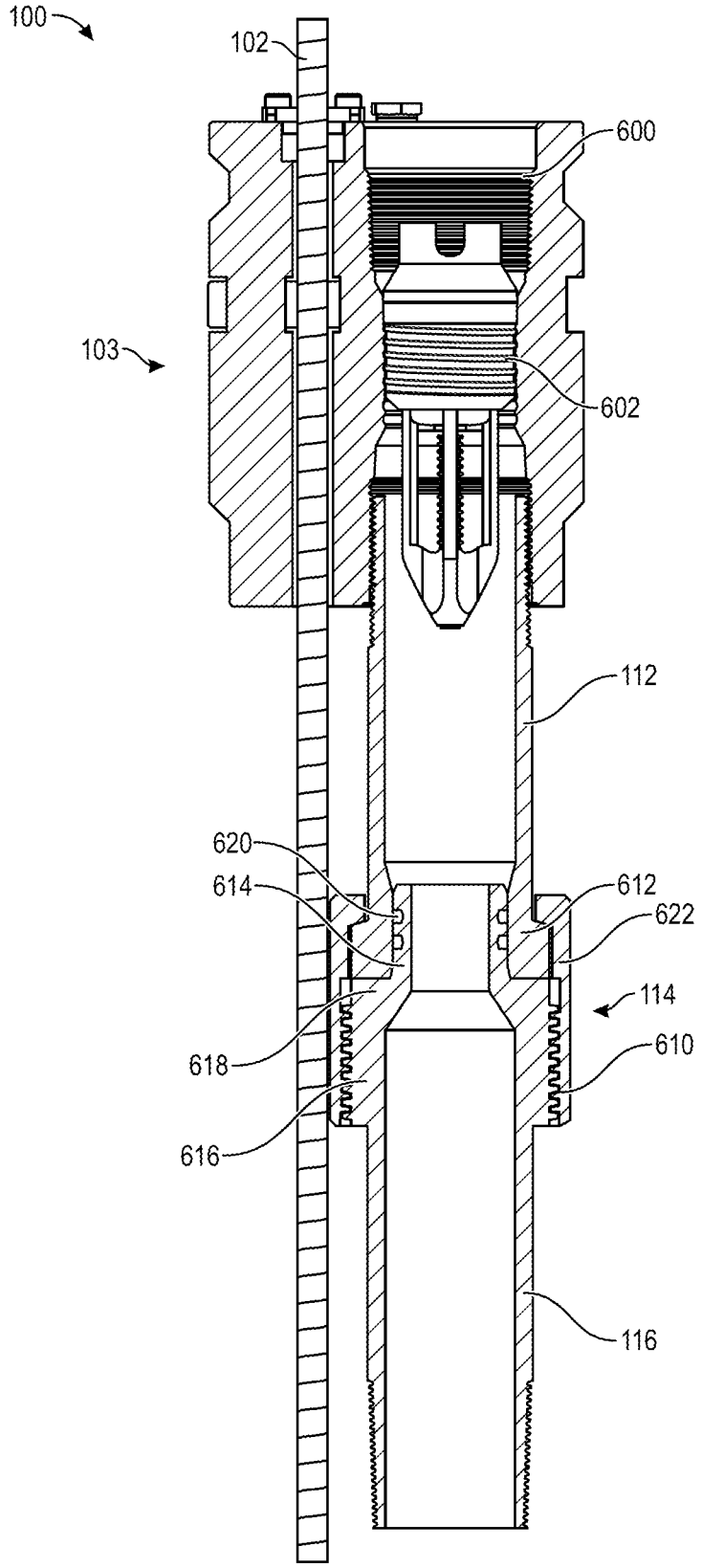
FIG. 6 illustrates a side, cross-sectional view of the split hanger assembly, according to an embodiment.

FIG. 6 illustrates a cross-sectional view of the split hanger assembly 100, including the split hanger 103 and the swivel 114, according to an embodiment. As shown, the split hanger 103 may provide a through-bore 600. An h-style back pressure valve 602 may be received into the through-bore 600 to control fluid flow therein during deployment.

The swivel 114 may permit rotation of the split hanger 103 relative to the production tubular above/below the split hanger assembly 100. For example, the swivel 114 may include a profiled end 610 of the lower sub 116, and a profiled end 612 of the intermediate sub 112. The profiled end 610 may include a nose 614 and a threaded portion 616. The profiled end 612 may include a shoulder 618.

The nose 614 may extend into the profiled end 612 of the intermediate sub 112, and seals 620 may form a fluid-tight engagement therebetween. A sleeve 622 may be received around the profiled end 612 and threaded onto the threaded portion 616 of the profiled end 610, such that the sleeve 622 engages the shoulder 618. Accordingly, because the nose 614 extends into the profiled end 610, a seal is formed across a range of relative axial positions of the intermediate sub 112 and the lower sub 116. This permits a range of circumferential positions of the split hanger 103, permitting the split hanger 103 to be oriented circumferentially to receive the cable 102 and the secondary tubular 104 without requiring the cable 102 and/or secondary tubular 104 to deviate from straight in the axial direction.

Figure 7:
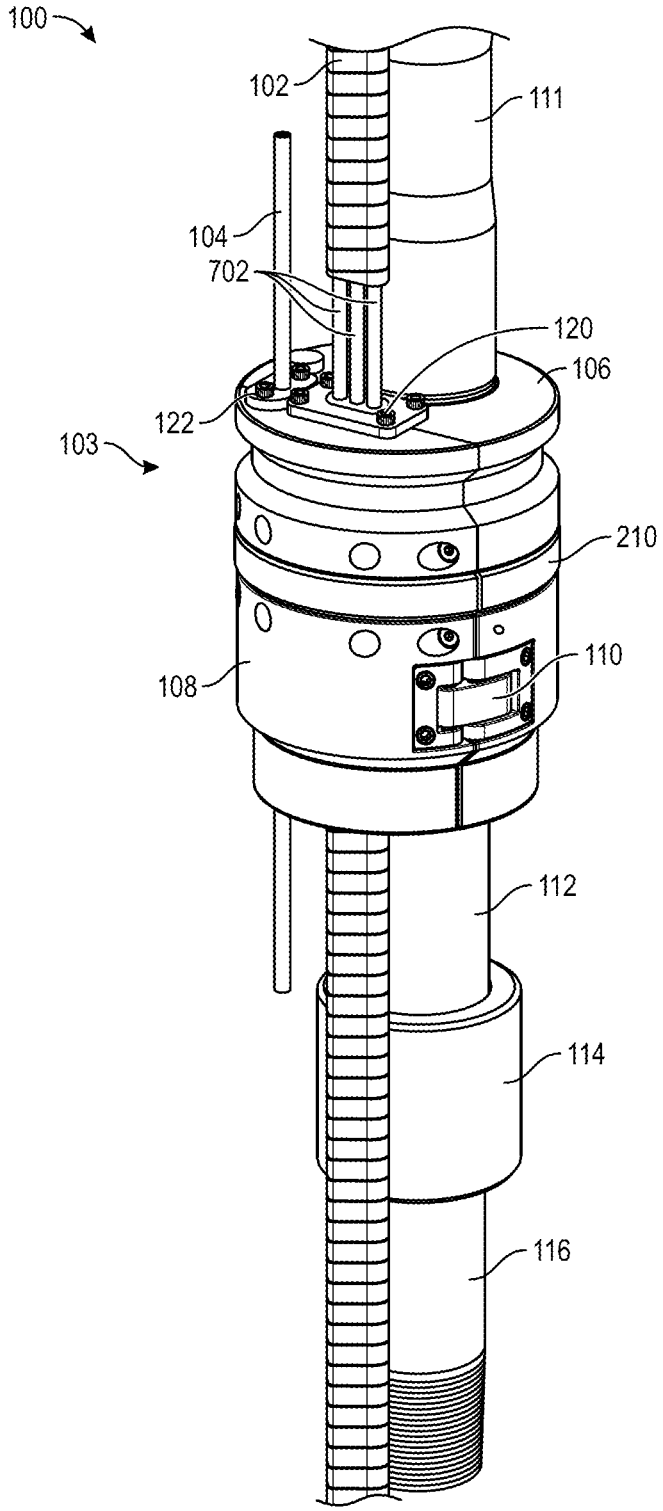
FIG. 7 illustrates a side view of another embodiment of the split hanger assembly with the door thereof in a closed position.
Figure 8:
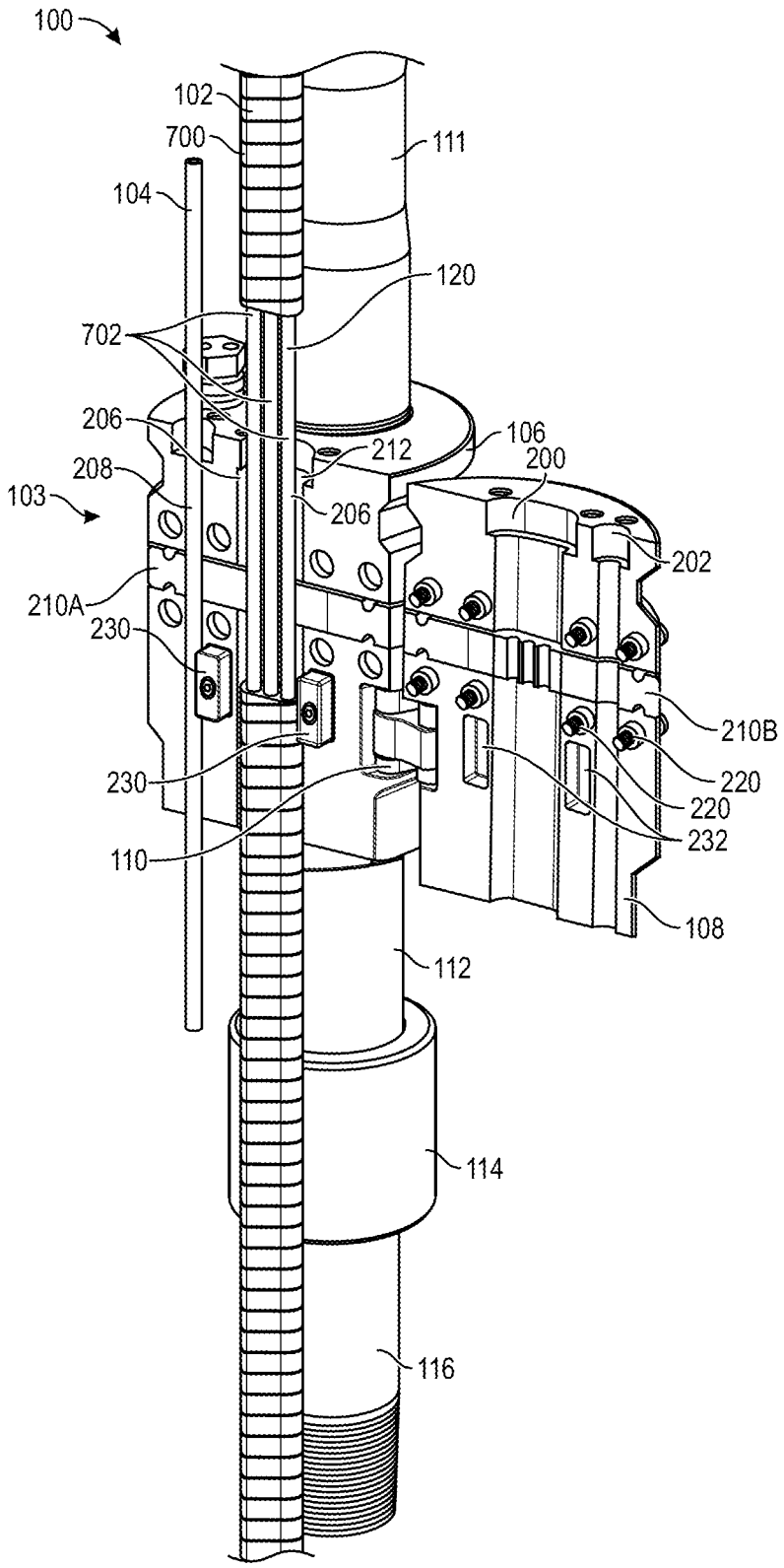
FIG. 8 illustrates a side view of another embodiment of the split hanger assembly with the door thereof in an open position.

FIGS. 7 and 8 illustrate another embodiment of the split hanger assembly 100. In this embodiment, the split hanger 103 is configured to receive the cable 102 after an outer armor 700 is stripped from the cable 102. Stripping the outer armor 700 reveals (e.g., three) insulated wires 702 therein. In some embodiments, it may not be acceptable to form a seal with the outer armor 700, and thus forming a seal with the insulation on the wires 702 may be provided. The flange 120 may be adjusted to seal with the wires 702, rather than a single, monolithic cable 102 (e.g., providing several holes) rather than one large slot. Similarly, as shown in FIG. 8 specifically, the primary seal insert 210 may be provided with individual passageways for the individual wires 702, rather than one slot.

Figure 9A:
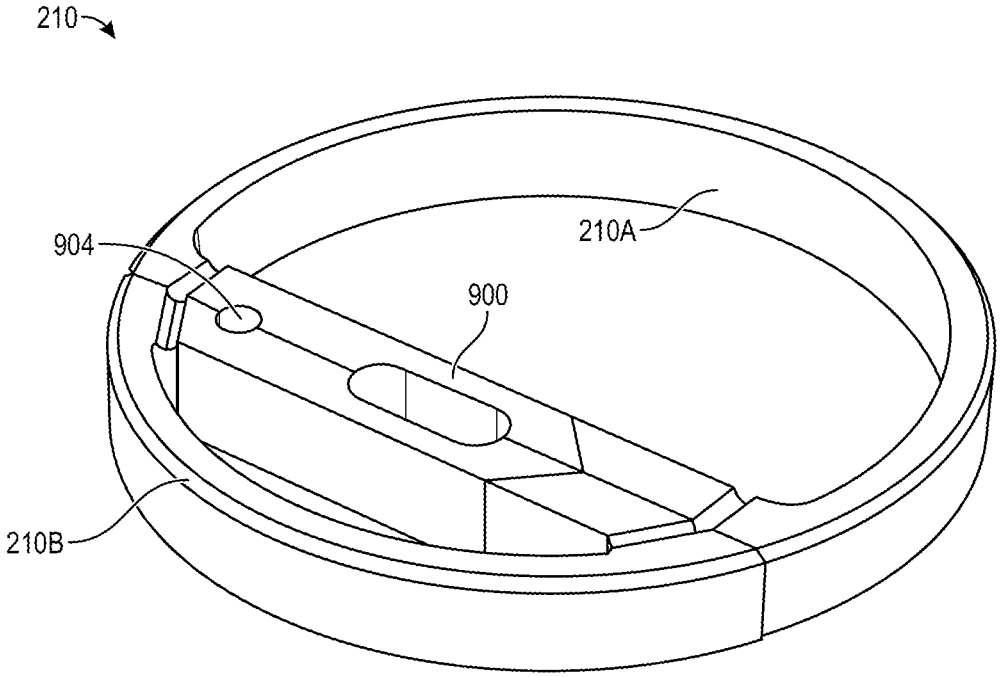
FIGS. 9A and 9B illustrate perspective views of a first embodiment and a second embodiment, respectively, of a seal insert of the split hanger.
Figure 9B:
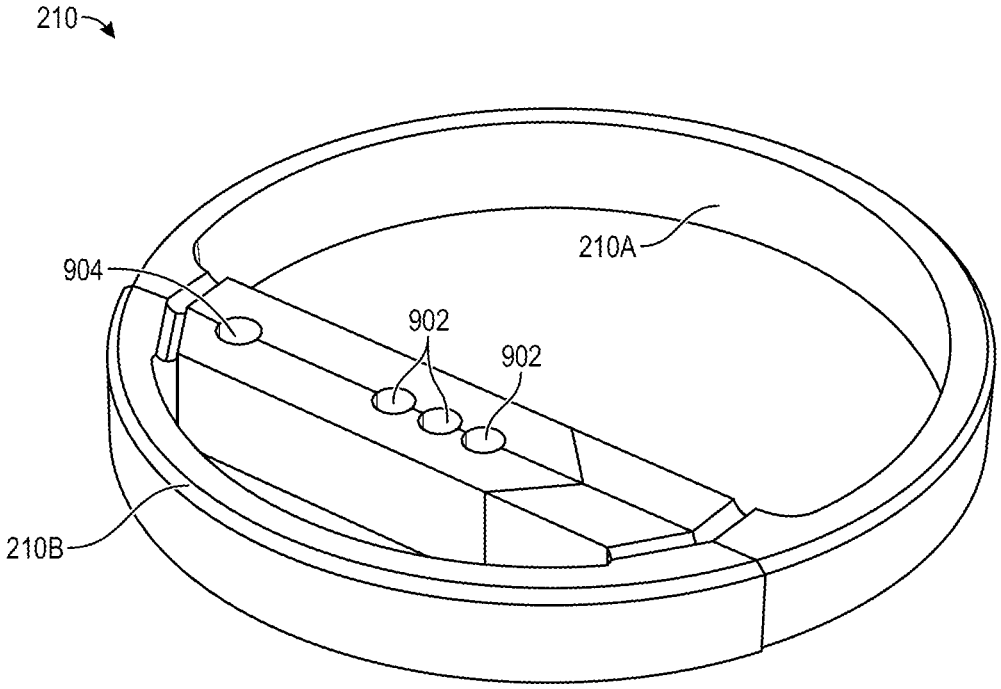

FIG. 9A illustrates the primary seal insert 210 (e.g., in the embodiment of FIG. 1), and FIG. 9B illustrates the primary seal insert 210 (e.g., in the embodiment of FIGS. 7 and 8). As shown in both, the first seal insert 210A is configured to extend around the main body 106, and the second seal insert 210B is configured to extend around the door 108. The inserts 210A, 210B may press against one another when the door 108 is closed against the main body 106. Further, the primary seal insert 210 provide a single passageway 900 for the cable 102, formed jointly by the inserts 210A, 210B, in FIG. 9A, or several passageways 902 for the individual wires 702, formed jointly by the inserts 210A, 210B, in FIG. 9B. A secondary passageway 904 is provided for the secondary tube 104. In both embodiments, the primary seal insert 210 may be scarf cut to facilitate assembly and replacement. The primary seal insert 210 may be made from an elastomeric material.

Figure 10:
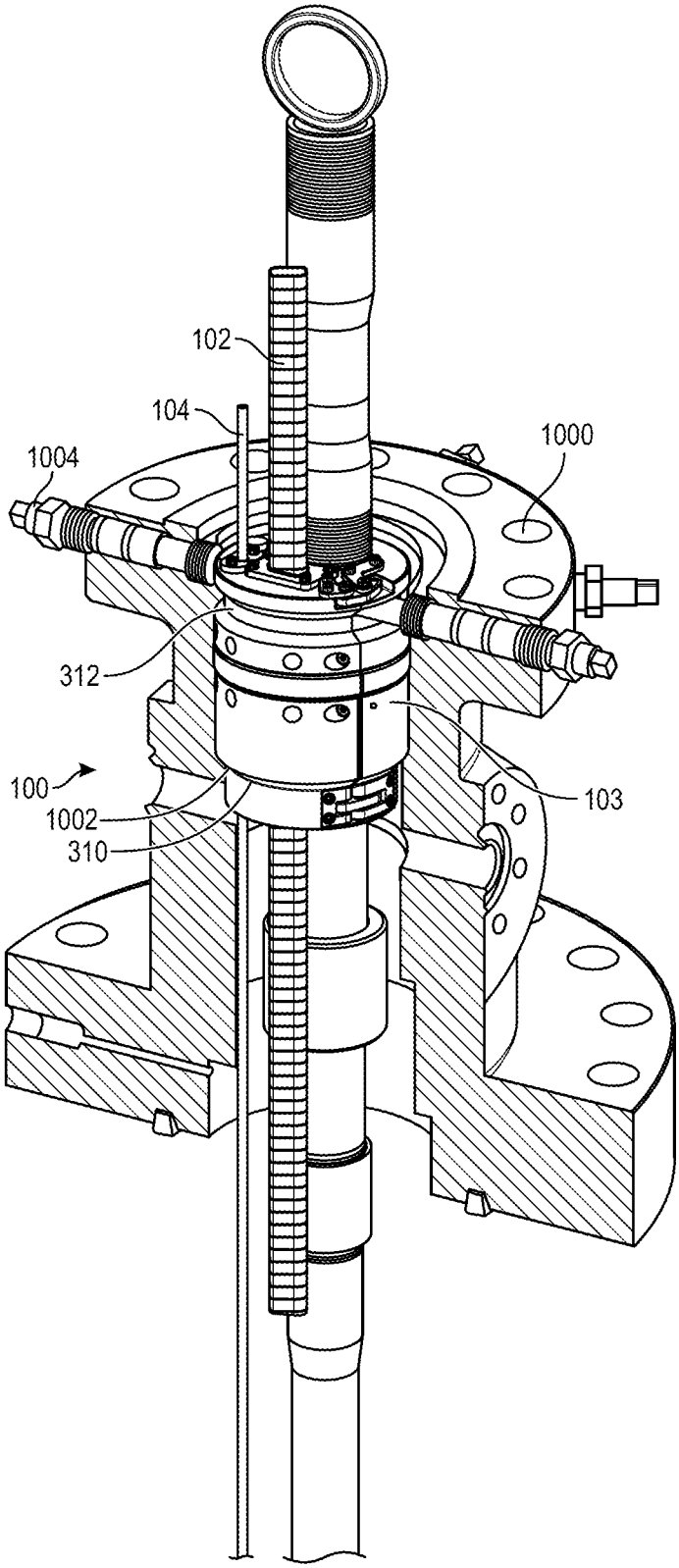
FIG. 10 illustrates a sectional view of the split hanger assembly positioned in a wellhead, according to an embodiment.

FIG. 10 illustrates a side, sectional view of the split hanger assembly 100 disposed in a wellhead 1000, according to an embodiment. As shown, the split hanger 103, specifically the load surface 310, is positioned on a load shoulder 1002 of the wellhead 1000, thereby supporting the weight of the split hanger assembly 100 and any production tubing hanging therefrom. Further, locking members (e.g., screws) 1004 are received into the locking groove 312, preventing displacement (e.g., upwards) in the wellhead 1000. Moreover, the primary seal insert 210 forms a fluid tight seal around the exterior of the split hanger 103 and with the interior of the wellhead 1000, which is made tighter by axial compression of the split hanger 103 when it is under load (i.e., carrying the weight of the production tubing).

Figure 11:
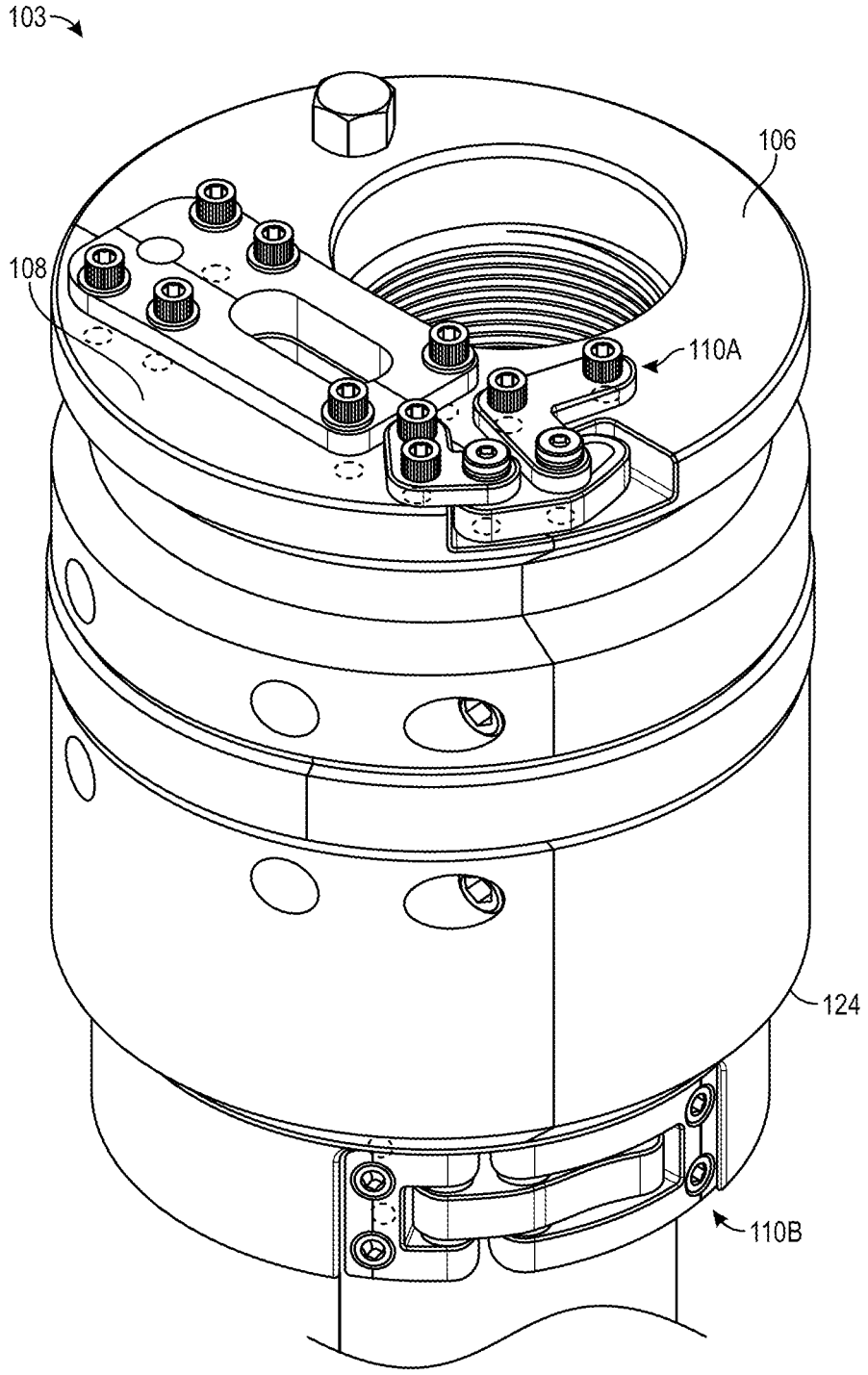
FIG. 11 illustrates another embodiment of the split hanger, according to an embodiment.

FIG. 11 illustrates another embodiment of the split hanger 103. Here, the hinge 110 in the embodiment of FIGS. 1-5 has been replaced with two hinges 110A, 110B. More particularly, the split hanger 103 may include a first (e.g., upper) hinge 110A proximate to an upper end of the main body 106 and/or side door 108, and a second (e.g., lower) hinge 110B proximate to a lower end of the main body 106 and/or side door 108. The lower hinge 110B may be positioned below a shoulder 124 on the neck of the main body 106 and/or side door 108. The hinges 110A, 110B may allow the side door 108 to swing between the open and closed positions more smoothly. They may also or instead allow the smaller hanger (e.g., side door 108) to be pulled apart from the larger hanger (e.g., main body 106) and swung out and away.

Figure 12:
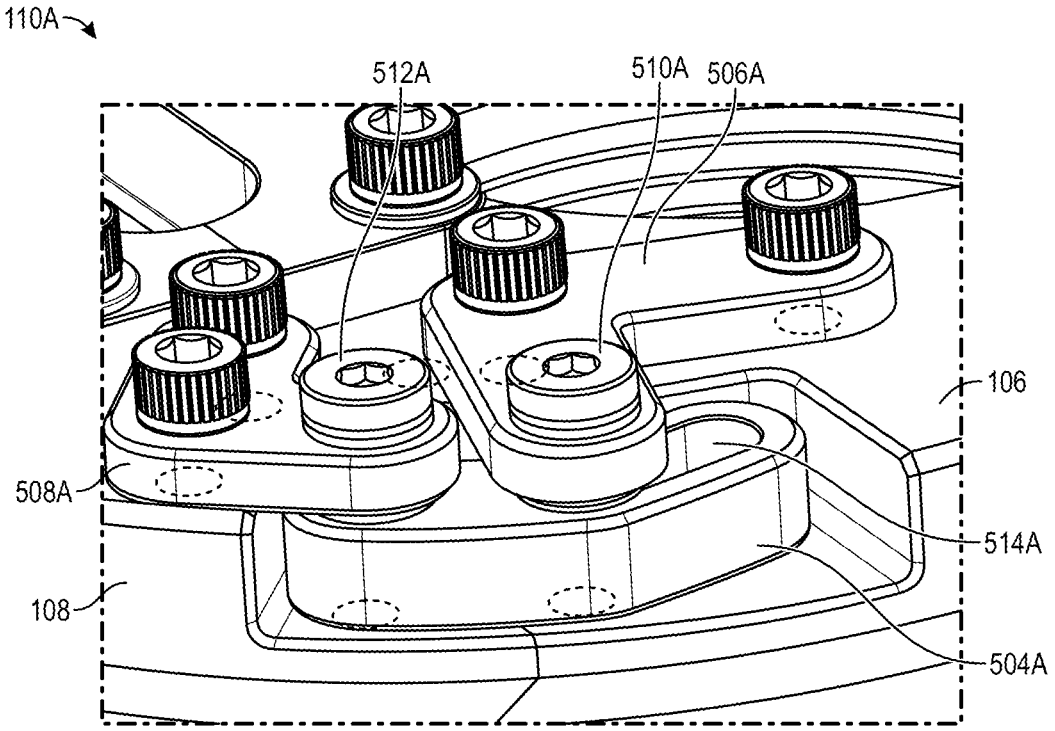
FIG. 12 illustrates a perspective view of a portion of the split hanger of FIG. 11, according to an embodiment.

FIG. 12 illustrates a perspective view of a portion of the split hanger 103 of FIG. 11 (e.g., the upper hinge 110A). The upper hinge 110A sits at the top of the split hanger 103 (e.g., the main body 106 and/or side door 108) and provides stability therebetween. The upper hinge 110A includes a body link 506A that is coupled to the main body 106, and a door link 508A that is coupled to the side door 108. The upper hinge 110A also includes an intermediate link 504A that is coupled to and positioned between the links 506A, 508A (e.g., by shoulder bolts 510A, 512A). In the embodiment shown, the shoulder bolt 510A may be positioned within a slot 514A in the intermediate link 504A. This may allow the shoulder bolt 510A to move laterally from end-to-end within the slot 514A. In contrast, the shoulder bolt 512A may be positioned within a circular opening in the intermediate link 504A which prevents lateral movement of the shoulder bolt 512A.

Figure 13:
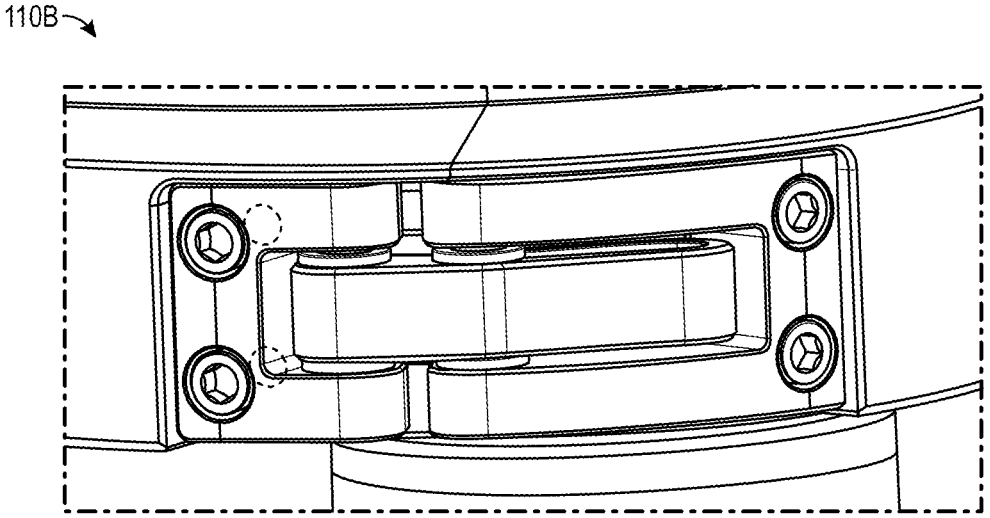
FIG. 13 illustrates a perspective view of another portion of the split hanger of FIG. 11, according to an embodiment.

FIG. 13 illustrates a perspective view of a portion of the split hanger 103 of FIG. 11 (e.g., the lower hinge 110B). The lower hinge 110B may be positioned below the shoulder 124 (see FIG. 11) on the main body 106 and/or side door 108. The lower hinge 510B may be or include a clevis and link system.

Figure 14:
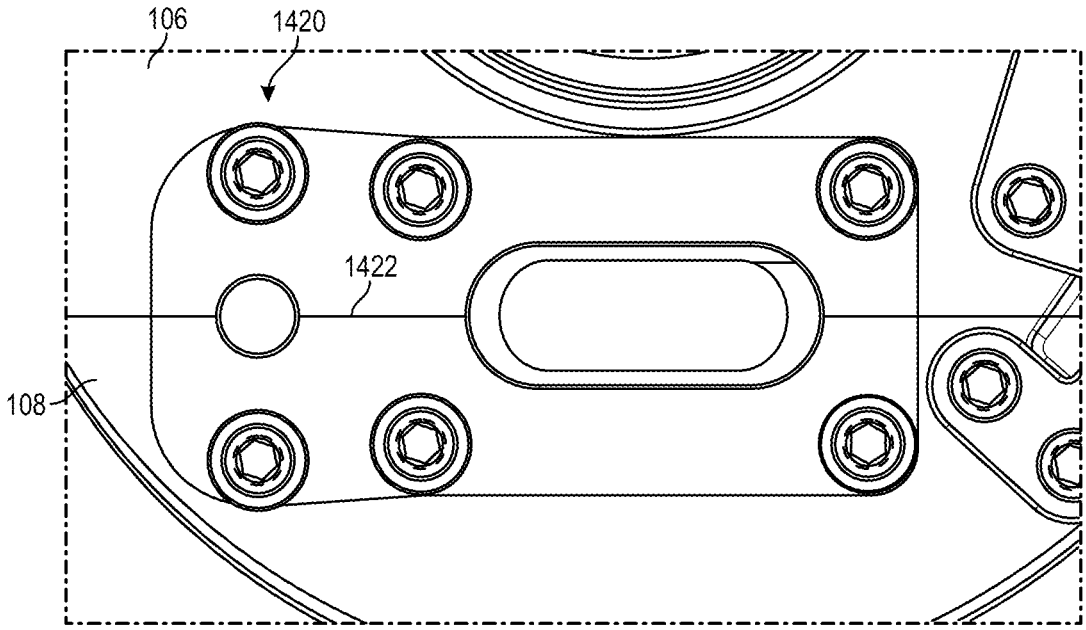
FIG. 14 illustrates a partially exploded perspective view of a portion of the split hanger showing a different flange.
Figure 15:
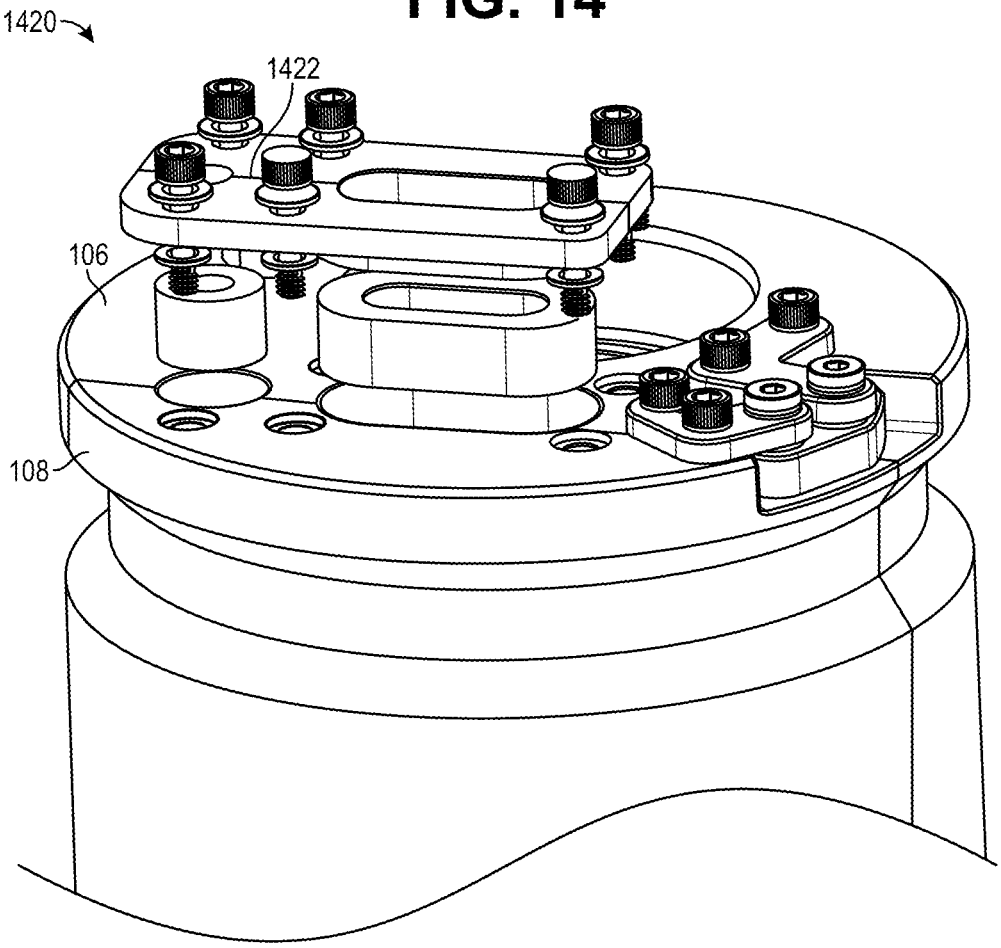
FIG. 15 illustrates a top view of the flange, according to an embodiment.

FIG. 14 illustrates a partially exploded perspective view of a portion of the split hanger 103 showing a different flange 1420, and FIG. 15 illustrates a top view of the flange 1420. Here, the rubber pack-off parts to seal on the cable 102 and/or the secondary tube 104 are still separate. However, unlike the flanges 120, 122 described above, the flange 1420 in FIG. 14, which is used to compress the cable 102 and/or the secondary tube 104, may be combined and split along the middle (e.g., see split line 1422) to facilitate installation.

Figure 16:
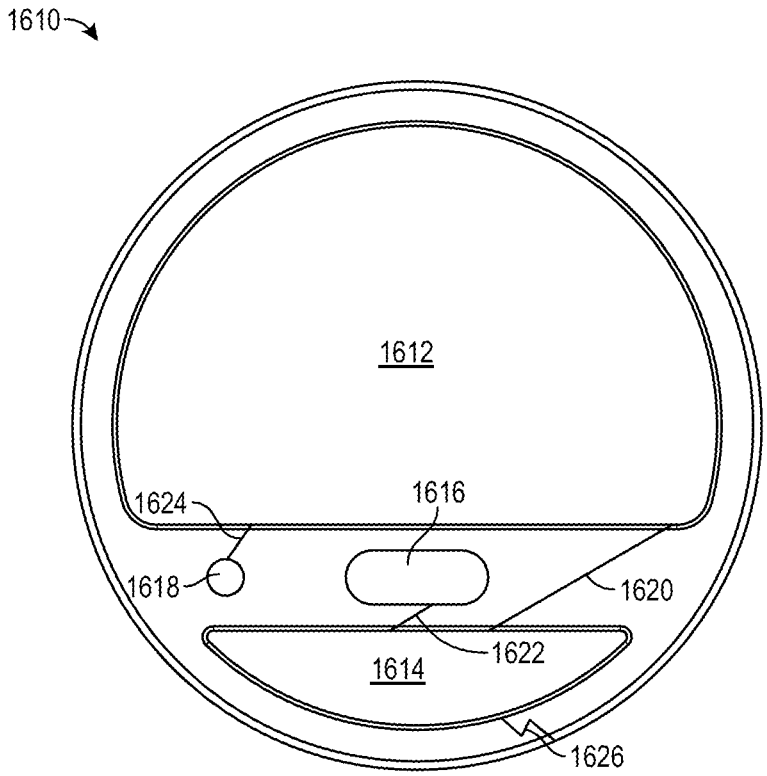
FIG. 16 illustrates a top view of another embodiment of the primary seal insert, according to an embodiment.

FIG. 16 illustrates a top view of another embodiment of the primary seal insert 1610. The primary seal insert 1610 may be similar to the primary seal insert 210 shown in FIGS. 1, 9A, and 9B. However, unlike the primary seal insert 210, which included two rubber inserts 210A, 210B to create a radial seal and a seal on the split face, the primary seal insert 1610 may be a single, integral component. The primary seal insert 1610 may be molded to include large hanger opening 1612, a small hanger opening 1614, a cable opening 1616, and a secondary tube opening 1618. The primary seal insert 1610 may subsequently be scarf cut to allow entry of the large hanger (e.g., main body 106) into the large hanger opening 1612, the small hanger (e.g., side door 108) into the small hanger opening 1614, the cable 102 into the cable opening 1616, and the secondary tube 104 into the secondary tube opening 1618.

More particularly, the primary seal insert 1610 may include a first scarf cut 1620 extending from the large hanger opening 1612 to the small hanger opening 1614. In the embodiment shown, the primary seal insert 1610 may also include a second scarf cut 1622 extending form the small hanger opening 1614 to the cable opening 1616, and a third scarf cut 1624 extending from the large hanger opening 1612 to the secondary tube opening 1618. In another embodiment, the second scarf cut 1622 may instead extend from the large hanger opening 1612 to the cable opening 1616, and/or the third scarf cut 1624 may instead extend from the small hanger opening 1614 to the secondary tube opening 1618. The primary seal insert 1610 may also include a fourth scarf cut 1626 extending from the small hanger opening 1614 to an exterior of the primary seal insert 1610. Alternatively, the fourth scarf cut 1626 may instead extend from the large hanger opening 1612 to the exterior of the primary seal insert 1610. The fourth scarf cut 1626 may include one or more turns (e.g., a zig-zag or "Z" shape), which may provide an overlapping locking mechanism designed to hold the two portions of rubber together when installed. This prevents them from separating after installation to ensure they do not get hung up (or the ends separate) when being installed into the wellhead.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An assembly configured to be inserted into a wellhead, the assembly comprising:

a body;

a door that is pivotally coupled to the body, wherein the door is configured to pivot between a closed position and an open position, and wherein an interface between the body and the door defines:

a first passage configured to have a cable pass therethrough; and a second passage configured to have a secondary tube pass therethrough;

one or more flanges coupled to an upper surface of the body, the door, or both, wherein the one or more flanges are configured to compress packing seals into fluid-tight engagement with the cable, the body, and the door and with the secondary tube, the body, and the door;

one or more hinges that pivotally couple the body to the door, wherein the one or more hinges comprise a first hinge that is recessed at least partially into the body and the door; and a primary seal insert positioned at least partially within the body and the door, wherein the primary seal insert expands radially-outward to seal with the wellhead in response to being axially-compressed.

2. The assembly of claim 1, wherein the body is configured to be positioned between an upper sub and a lower sub, wherein the first passage allows the cable to pass therethrough from the upper sub to the lower sub, and wherein the second passage allows the secondary tube pass to therethrough from the upper sub to the lower sub.

3. The assembly of claim 1, wherein one or more first captive fasteners secure the door in the closed position, and wherein one or more second captive fasteners secure the one or more flanges to the body, the door, or both.

4. The assembly of claim 1, wherein the one or more flanges are split into two portions that are laterally-adjacent to one another, and wherein the cable and the secondary tube are configured to extend through the two portions.

5. The assembly of claim 1, wherein the first hinge comprises a clevis and link system.

6. The assembly of claim 1, wherein the primary seal insert comprises:

a first insert positioned at least partially between an upper portion of the body and a lower portion of the body; and a second insert positioned at least partially between an upper portion of the door and a lower portion of the door, wherein the first and second inserts are pressed together and against the cable and the secondary tube when the door is in the closed position, thereby preventing fluid communication between the body and the door along the cable, the secondary tube, or both.

7. The assembly of claim 1, wherein the primary seal insert comprises a single insert positioned at least partially between upper and lower portions of the body and between upper and lower portions of the door, wherein the single insert defines a large hanger opening, a small hanger opening, a cable opening, and a secondary tube opening, and wherein the single insert comprises a plurality of scarf cuts that facilitate installation of the cable into the cable opening and facilitate installation of the secondary tube into the secondary tube opening.

8. The assembly of claim 1, further comprising a swivel coupled to the body, wherein the swivel is configured to permit the body and the door to be positioned across a range of circumferential positions relative to a tubular string to which the swivel is also coupled.

9. An assembly configured to be inserted into a wellhead, the assembly comprising:

a body;

a door that is pivotally coupled to the body, wherein the door is configured to pivot between a closed position and an open position, and wherein an interface between the body and the door defines:

a first passage configured to have a cable pass therethrough; and a second passage configured to have a secondary tube pass therethrough;

one or more hinges that pivotally couple the body to the door, wherein the one or more hinges comprise a first hinge that is recessed at least partially into the body and the door;

a primary seal insert positioned at least partially within the body and the door, wherein the primary seal insert expands radially-outward to seal with the wellhead in response to being axially-compressed; and an axial load-bearing feature between the body and the door that transfers axial loads from the assembly to the wellhead, and wherein the axial load-bearing feature comprises:

a lug that is coupled to or integral with the body; and a recess formed in the door.

10. A split hanger assembly configured to be inserted into a wellhead, the split hanger assembly comprising:

a body configured to be positioned between an upper sub and a lower sub;

a door that is pivotally coupled to the body, wherein the door is configured to pivot between a closed position and an open position, wherein an interface between the body and the door defines:

a first passage configured to have a cable pass therethrough from the upper sub to the lower sub; and a second passage configured to have a secondary tube pass therethrough from the upper sub to the lower sub;

one or more hinges that pivotally couple the body to the door, wherein the one or more hinges comprise a first hinge that is recessed at least partially into the body and the door;

one or more flanges coupled to the upper surface of the body, the door, or both, wherein the one or more flanges are configured to compress packing seals into fluid-tight engagement with the cable, the body, and the door and with the secondary tube, the body, and the door;

a primary seal insert positioned at least partially within the body and the door, wherein the primary seal insert expands radially-outward to seal with the wellhead in response to being axially-compressed; and an axial load-bearing feature positioned between the body and the door that transfers axial loads from the split hanger assembly to the wellhead.

11. The split hanger assembly of claim 10, wherein one or more first captive fasteners secure the door in the closed position, and wherein one or more second captive fasteners secure the one or more flanges to the body, the door, or both.

12. The split hanger assembly of claim 10, wherein the primary seal insert comprises:

a first insert positioned at least partially between an upper portion of the body and a lower portion of the body; and a second insert positioned at least partially between an upper portion of the door and a lower portion of the door, wherein the first and second inserts are pressed together and against the cable and the secondary tube when the door is in the closed position, thereby preventing communication between the body and the door along the cable, the secondary tube, or both.

13. The split hanger assembly of claim 10, wherein the primary seal insert comprises a single insert positioned at least partially between upper and lower portions of the body and between upper and lower portions of the door, wherein the single insert defines a large hanger opening, a small hanger opening, a cable opening, and a secondary tube opening, and wherein the single insert comprises a plurality of scarf cuts that facilitate installation of the cable into the cable opening and facilitate installation of the secondary tube into the secondary tube opening.

14. The split hanger assembly of claim 10, wherein the axial load-bearing feature comprises a lug that is coupled to or integral with the body and a recess formed in the door.

15. A split hanger assembly configured to be inserted into a wellhead and to support a production tubing within a wellbore, the split hanger assembly comprising:

a body configured to be positioned between an upper sub and a lower sub;

a door that is pivotally coupled to the body, wherein the door is configured to pivot between a closed position and an open position, wherein one or more first captive fasteners secure the door in the closed position, and wherein an interface between the body and the door defines:

a first passage configured to have a cable pass therethrough from the upper sub to the lower sub; and a second passage configured to have a secondary tube pass therethrough from the upper sub to the lower sub;

one or more hinges that pivotally couple the body to the door, wherein the one or more hinges comprise a first hinge that is recessed at least partially into the body and the door;

one or more flanges coupled to an upper surface of the body, the door, or both, wherein the one or more flanges are configured to compress packing seals into fluid-tight engagement with the cable, the body, and the door and with the secondary tube, the body, and the door, and wherein one or more second captive fasteners secure the one or more flanges to the body, the door, or both;

a primary seal insert positioned at least partially within the body and the door and above the first hinge, wherein the primary seal insert expands radially-outward to seal with the wellhead in response to being axially-compressed; and an axial load-bearing feature between the body and the door that transfers axial loads from the split hanger assembly to the wellhead, wherein the axial load-bearing feature comprises a lug that is coupled to or integral with the body and a recess formed in the door.

16. The split hanger assembly of claim 15, wherein the body and the door define a shoulder that is positioned below the primary seal insert, and wherein the first hinge is positioned between the primary seal insert and the shoulder.

17. The split hanger assembly of claim 15, wherein the body and the door define a shoulder that is positioned below the primary seal insert, and wherein the first hinge is positioned below the primary seal insert and the shoulder.

18. The split hanger assembly of claim 17, wherein the one or more hinges further comprise a second hinge that is positioned above the primary seal insert and on the upper surface of the body and the door.

19. The split hanger assembly of claim 18, wherein the first hinge, the second hinge, or both comprise a center link defining a first link opening and a second link opening, wherein the second link opening has a greater width than the first link opening to permit a bolt therein to slide from a first end of the second link opening to a second end of the second link opening.

* * * * *